US009793623B2

(12) United States Patent
Chen et al.

(10) Patent No.: US 9,793,623 B2
(45) Date of Patent: Oct. 17, 2017

(54) COAXIAL CABLE CONNECTOR ASSEMBLY AND A RECEPTOR CONNECTOR

(71) Applicant: HARUMOTO TECHNOLOGY (SHEN ZHEN) CO., LTD., Shenzh (CN)

(72) Inventors: Shih-Chieh Chen, Taipei (TW); Chia-Hsin Wang, Taipei (TW); Chin-Chuan Kung, Taipei (TW)

(73) Assignee: HARUMOTO TECHNOLOGY (SHEN ZHEN) CO., LTD., Shenzh (CN)

( * ) Notice: Subject to any disclaimer, the term of this patent is extended or adjusted under 35 U.S.C. 154(b) by 171 days.

(21) Appl. No.: 14/709,464

(22) Filed: May 11, 2015

(65) Prior Publication Data

US 2015/0244086 A1 Aug. 27, 2015

Related U.S. Application Data

(63) Continuation-in-part of application No. 13/951,177, filed on Jul. 25, 2013, now Pat. No. 9,059,521.

(30) Foreign Application Priority Data

Sep. 29, 2012 (CN) ..... 2012 1 0370677

(51) Int. Cl.

| | |
|---|---|
| ***H01R 9/05*** | (2006.01) |
| *H01R 103/00* | (2006.01) |
| *H01R 13/22* | (2006.01) |
| *H01R 24/50* | (2011.01) |
| *H01R 12/75* | (2011.01) |

(52) U.S. Cl.

CPC ..... *H01R 9/0518* (2013.01); *H01R 9/0515* (2013.01); *H01R 12/75* (2013.01); *H01R 13/22* (2013.01); *H01R 24/50* (2013.01); *H01R 2103/00* (2013.01)

(58) Field of Classification Search

CPC .... H01R 24/38; H01R 9/0524; H01R 9/0518; H01R 24/46; H01R 13/422

USPC ..... 439/63, 581–582, 585

See application file for complete search history.

(56) References Cited

U.S. PATENT DOCUMENTS

| | | | | |
|---|---|---|---|---|
| 6,257,912 | B1 * | 7/2001 | Boillot | H01R 9/0515 439/329 |
| 6,533,609 | B2 * | 3/2003 | Koide | H01R 9/0518 439/578 |
| 7,059,884 | B2 * | 6/2006 | Hisaeda | H01R 13/20 439/329 |
| 7,497,715 | B2 * | 3/2009 | Wu | H01R 13/20 439/329 |

(Continued)

*Primary Examiner* — Tho D Ta
*Assistant Examiner* — Thang Nguyen
(74) *Attorney, Agent, or Firm* — Chun-Ming Shih

(57) ABSTRACT

A coaxial cable connector assembly and a receptor connector are provided. The coaxial cable connector assembly is composed at least of one cable end connector and the receptor connector. The receptor connector is formed of an insertion space with a lateral insertion opening to allow one portion of the cable end connector to be inserted into the insertion space through the lateral insertion opening such that the cable end connector and the receptor connector are in electrical connection. The cable end connector will be constrained such that it cannot be detached from the receptor connector in the direction other than the lateral insertion opening.

16 Claims, 10 Drawing Sheets

(56) References Cited

U.S. PATENT DOCUMENTS

| | | | | |
|---|---|---|---|---|
| 9,160,089 | B2 * | 10/2015 | Shimoji | H01R 12/7082 |
| 9,490,591 | B2 * | 11/2016 | Yamashita | H01R 24/40 |
| 2010/0062640 | A1 * | 3/2010 | Maruyama | H01R 9/0518<br>439/582 |
| 2012/0295477 | A1 * | 11/2012 | Funahashi | H01R 24/545<br>439/578 |
| 2016/0164199 | A1 * | 6/2016 | Hashimoto | H01R 24/38<br>439/578 |

* cited by examiner

COAXIAL CABLE CONNECTOR ASSEMBLY AND A RECEPTOR CONNECTOR

CROSS-REFERENCE TO RELATED APPLICATIONS

This application claims the priority of China Patent Application No. 201210370677.5 filed on Sep. 29, 2012, in the State Intellectual Property Office of the P.R.C., the disclosure of which is incorporated herein by reference.

BACKGROUND OF THE INVENTION

Field of the Invention

The present invention relates to a coaxial cable connector assembly and a receptor connector, specifically, to a mutually lateral insertion type coaxial cable connector assembly, and a receptor connector having a lateral insertion opening.

Descriptions of the Related Art

It is understood that a coaxial cable is usually used in signal transmission for various electronic products; particularly, it is applied to RF signal transmission and antenna field more widely. As the development of electronic products towards to miniaturization, the size of connectors used for coaxial cables in electronic products is necessary to be scaled down significantly. General speaking, a connector of a coaxial cable may be composed of a receptor connector and a cable end connector. The receptor connector (refer to FIG. 1) is welded on a circuit board of an electronic product. As shown in FIG. 1, a middle portion of the receptor connector 1 is provided with a columnar receptor central terminal 11 and a cylindrical receptor shielding terminal 13. The receptor shielding terminal 13 is arranged to surround the receptor central terminal 11, the bottom of the receptor central terminal 11 extends outside a receptor central terminal pin 12, and the bottom of the receptor shielding terminal 13 extends outside a receptor shielding terminal pin 14. When in use, these pins 12, 14 may be connected on specified positions on the circuit board by SMT welding or other connection methods.

Refer to FIG. 2, it shows a schematic diagram of a conventional cable end connector. As shown in FIG. 2, a cable end connector 2 includes a cable end central terminal 21 and a cable end shielding terminal 22, wherein the cable end central terminal 21 is electrically connected to the central conductor (the so called core wire) of a coaxial cable 3, and the cable end shielding terminal 22 is in electrical connection with an external conductor of the coaxial cable 3. The cable end connector 2 may be engaged to the receptor connector 1 as shown in FIG. 1 to connect electrically with the receptor central terminal 11 through the cable end central terminal 21. The cable end shielding terminal 22 and the receptor terminal shielding terminal 13 are in electrical connection such that the transmission of RF signal can be achieved between the coaxial cable 3 and a circuit board of an electronic product. For the engagement of a cable end connector and a receptor connector, a top-down engagement method is used currently. Please refer to FIG. 3, which is a conventional schematic diagram showing the engagement action of a cable end connector and a receptor connector. As shown in FIG. 3, the cable end connector 2 moves downwards from above to fit the receptor connector 1, and thereby the engagement of the cable end connector 2 and the receptor connector 1 is completed (refer to FIG. 4).

Because of the compactness requirement of sophisticated portable electronic products such as smart phones in recent years, the entire height after a cable end connector and a receptor connector are engaged is requested to be reduced continuously. For example, the engagement height of the cable end connector and the receptor connector has been reduced from the earliest 3.5 mm to 1.2 mm, and the current requirement is even below 1.0 mm. Although the lower engagement height meets the compactness requirement of electronic products, the contact height and area of the cable end connector and the receptor connector are insufficient such that the engagement strength between connectors is insufficient. Thus, the cable end connector may be detached from the receptor connector easily upon receiving an external impact force causing impact on normal functions of electronic products and even resulting in damage thereof.

Besides, a cable end connector and a receptor connector are engaged by the method of manual assembly work currently. Because the volume of the cable end connector is too small to be accessed by an operator, and the line of sight of the operator may be blocked by the finger easily such that the correct position of the receptor connector cannot be handled when the cable end connector, with its front face moving downwards from above, is engaged and assembled with the receptor connector, the operator cannot align the cable end connector with the receptor connector and thus the cable end connector and the receptor connector cannot be engaged effectively and even the connector is damaged due to inappropriate pressure, resulting in poor yield of electronic products and causing subsequent rework procedures. Although some vendors have tried to introduce an automatic engagement equipment that aligns the cable end connector with the receptor connector automatically to complete the engagement work of the cable end connector and the receptor connector in an automation method, the introduction of the automatic engagement equipment not only needs considerable expense, but also faces problems of overlarge space occupied by the mechanism of the equipment for picking and placement, such that the introduction to production line is impossible.

SUMMARY OF THE INVENTION

In view of aforementioned technical problems, the primary purpose of the present invention is to provide an improvement structure of a coaxial cable connector, which utilizes a mutually lateral insertion method for a cable end connector and a receptor connector to be engaged easily and effectively.

A secondary purpose of the present invention is to provide an improvement structure of a coaxial cable connector, which has an insertion opening provided on one side of a receptor connector to effectively reduce the entire height of the receptor connector and a cable end connector after engagement.

To achieve the above purposes and other purposes, the present invention provides a coaxial cable connector assembly, having a cable end connector and a receptor connector. The cable end connector is provided with a cable end central terminal, a cable end insulator, a cable end shielding terminal. Two ends of the cable end central terminal are provided with a cable end contact and a cable end central conductor junction, respectively. The cable end contact and the cable end central conductor junction are arranged on a fore-end and a rear end of the cable end insulator, respectively. The cable end contact is exposed at the fore-end of the cable end insulator. The cable end central conductor junction is used to join a central conductor of a coaxial cable. The cable end shielding terminal is provided with a stopping structure extending toward the fore-end of the cable end insulator to stop and limit the cable end insulator, and a cable end engagement structure is provided on one surface opposite to the cable end insulator. The cable end shielding terminal is provided with multiple clamps at the tail portion thereof to be integrated with an external conductor and a jacket (for example, an external rubber cover) of the coaxial cable by a crimping method. The receptor connector is provided with a receptor central terminal, a receptor insulator, a receptor shielding terminal. The receptor central terminal is arranged at the receptor insulator, and is provided with a receptor contact exposed at the receptor insulator. The receptor contact and the cable end contact have a structure corresponding relationship. The receptor central terminal is provided with a receptor central terminal pin extending outside the receptor insulator. The receptor shielding terminal is joined with the receptor insulator to form an insertion space having a lateral insertion opening for a fore-end portion of the cable end connector to enter the insertion space through the lateral insertion opening such that the cable end contact and the receptor contact are in electrical connection, and the cable end shielding terminal and the receptor shielding terminal are in electrical connection. The receptor shielding terminal is provided with a receptor engagement structure on the surface facing the receptor insulator for the cable end contact to engage with the cable end engagement structure when entering the insertion space. The receptor shielding terminal is further provided with a receptor shielding terminal pin extending outside the receptor insulator. the receptor shielding terminal further has a detection hole for detecting electrical properties of the cable end connector that enters into the insertion space.

The present invention further provides a receptor connector, having a receptor insulator, a receptor central terminal and a receptor shielding terminal, used for engaging a cable end connector provided with a cable end contact and a cable end shielding terminal. The receptor central terminal is located at the receptor insulator and is provided with a receptor contact exposed at the receptor insulator. The receptor central terminal further has a receptor central terminal pin extending outside the receptor insulator. The receptor shielding terminal is joined with the receptor insulator to form an insertion space having a lateral insertion opening for a portion of the cable end connector to enter the insertion space through the lateral insertion opening such that the cable end contact and the receptor contact are in electrical connection, and the cable end shielding terminal and the receptor shielding terminal are in electrical connection. The receptor shielding terminal is provided with a receptor engagement structure on the surface facing the receptor insulator to engage the cable end connector entering the insertion space. The receptor terminal shielding terminal further has a receptor shielding terminal pin extending outside the receptor insulator.

Compared with prior arts, the receptor connector provided by the present invention is provided with a receptor shielding terminal to form an insertion space and have a lateral insertion opening. The cable end connector may enter the insertion space through the lateral insertion opening. The inner wall of the receptor shielding terminal may limit the movement of the cable end connector such that the cable end connector that enters the insertion space cannot detach from the receptor connector in a director other than that of the lateral insertion opening. Thus, even though the engagement height of connectors is very low, the receptor connector may still provide sufficient engagement strength to the cable end connector such that the cable end connector is not detached easily from the receptor connector by an external impact force, thus improving the use stability of the connectors, and reducing the engagement height of the receptor connector and the cable end connector significantly.

DETAILED DESCRIPTION OF THE PREFERRED EMBODIMENT

Figure 1:
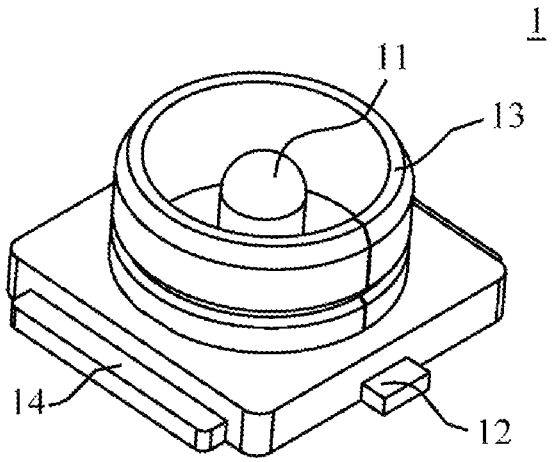
Fig.1 (Prior Art)
FIG. 1 is a schematic view of a conventional receptor connector.
Figure 2:
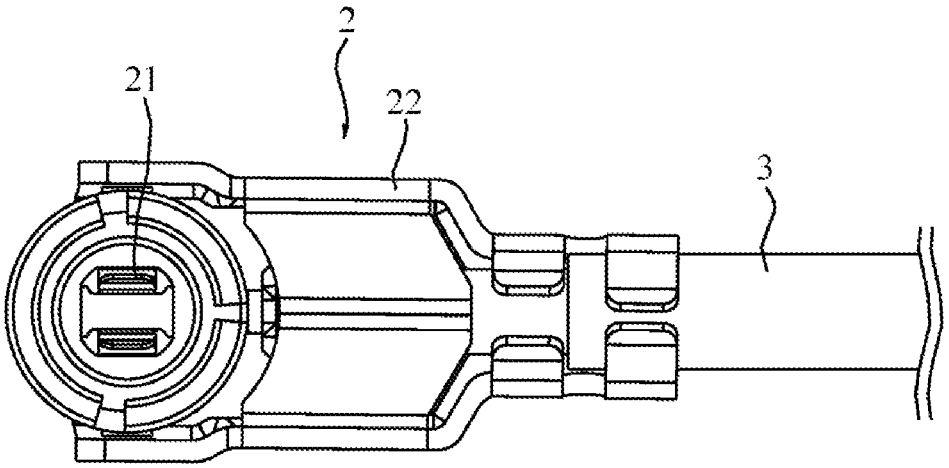
Fig.2 (Prior Art)
FIG. 2 is a schematic view of a conventional cable end connector.
Figure 3:
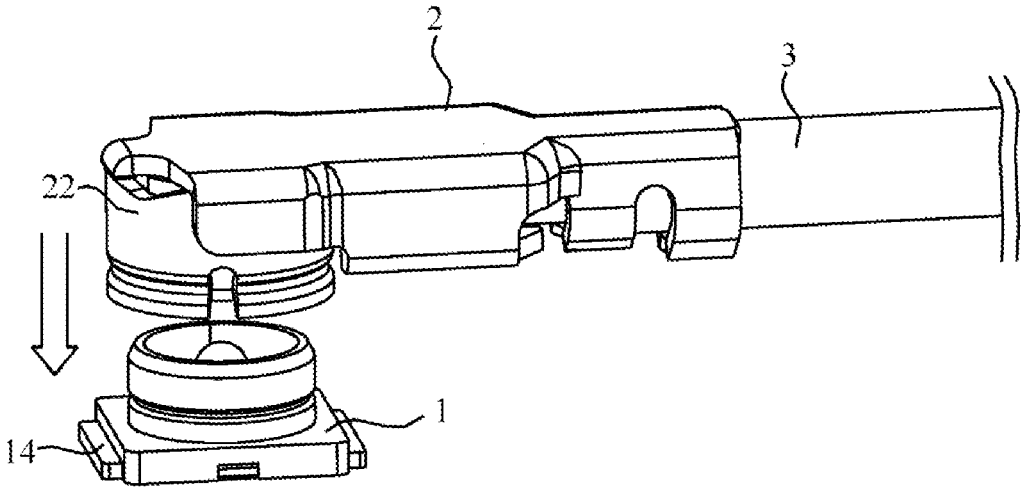
Fig.3 (Prior Art)
FIG. 3 is a schematic view showing an engagement action of a conventional cable end connector and a receptor connector.
Figure 4:
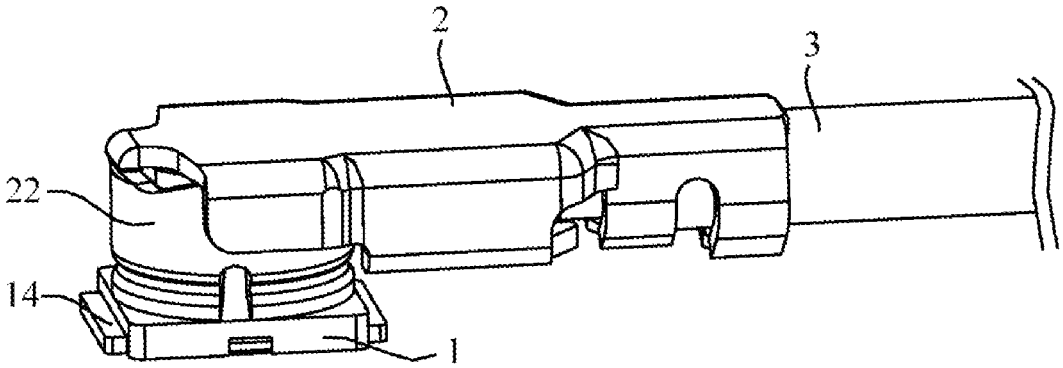
Fig.4 (Prior Art)
FIG. 4 is a schematic view showing the completion of an engagement action of a conventional cable end connector and a receptor connector.

For the purpose of reducing a height of a coaxial cable connector structure effectively to meet the size request of coaxial cable connectors in current industry, the present invention provides a new receptor connector and a coaxial cable connector assembly composed at least of a cable end connector and a receptor connector. Refer to FIG. 6 and FIGS. 9 to 12, which are schematic views showing a cable end connector according to the present invention. As shown in FIG. 10, a cable end connector 5 is provided with a cable end central terminal 51, a cable end insulator 52 and a cable end shielding terminal 53. Two ends of the cable end central terminal 51 are provided with a cable end contact 511 and a cable end central conductor junction 512, respectively. The cable end contact 511 and the cable end central conductor junction 512 are arranged on a fore-end and a rear-end of the cable end insulator 52, respectively. The cable end contact 511 is exposed at the fore-end of the cable end insulator 52. The cable end central conductor junction 512 is used to join a central conductor 41 (the so-called core wire) of a coaxial cable 4. The cable end shielding terminal 53 may provide an electrical shielding function and may be electrically connected to an external conductor 43 of the coaxial cable 4 to deliver a ground signal.

Figure 5:
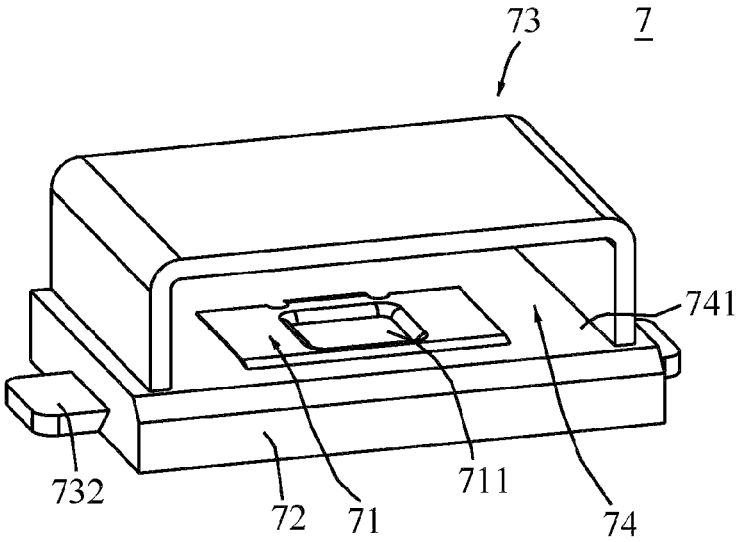
FIG. 5 is a schematic view showing a structure of a receptor connector according to the present invention.
Figure 6:
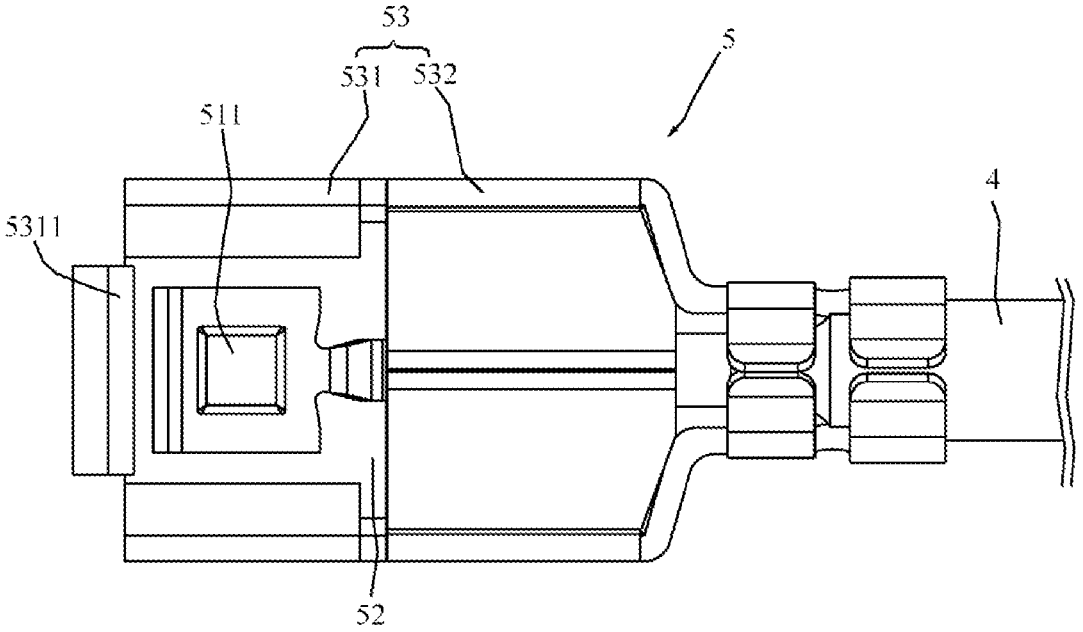
FIG. 6 is a schematic view showing a structure of a cable end connector after wire bonding according to the present invention.
Figure 13:
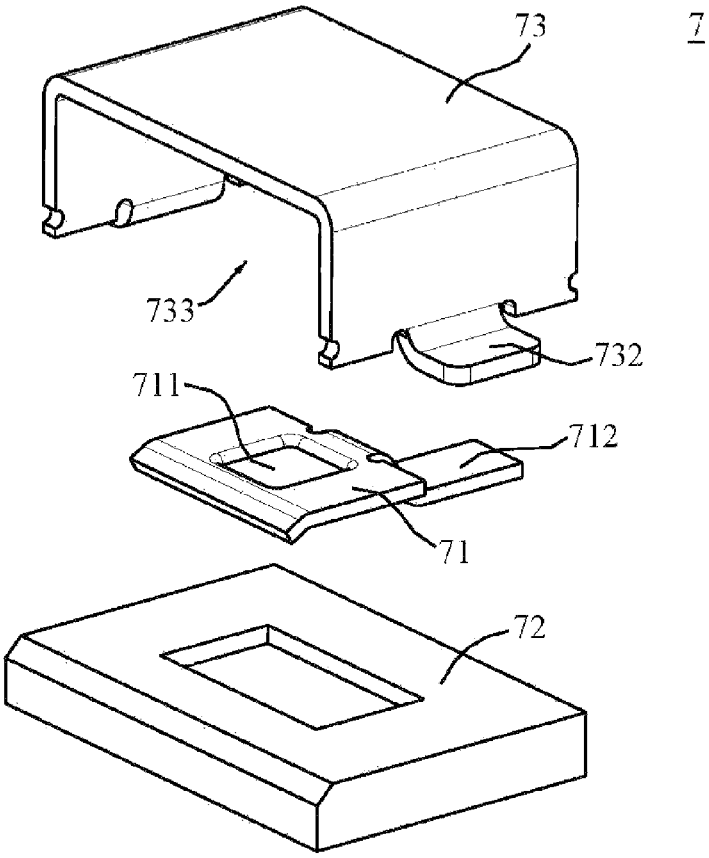
FIG. 13 is a schematic view showing the components of a structure of a receptor connector shown in FIG. 5.
Figure 14:
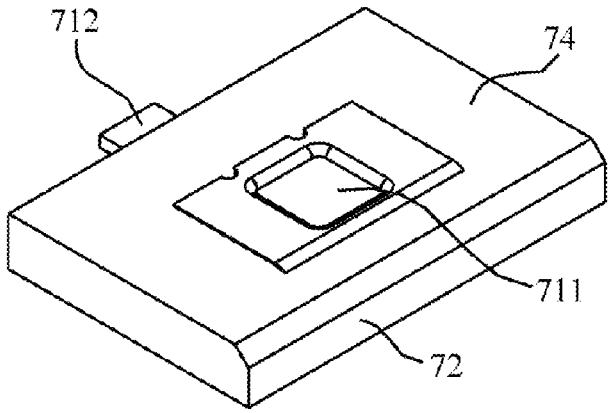
FIG. 14 is a schematic view showing the combination of a receptor insulator and a receptor central terminal shown in FIG. 13.

Further refer to FIG. 5 and FIGS. 13 to 14, which are schematic views of a structure of a receptor connector according to the present invention. As shown in FIG. 13, a receptor connector 7 is composed at least of a receptor central terminal 71, a receptor insulator 72 and a receptor shielding terminal 73. The receptor central terminal 71 is arranged at the receptor insulator 72 and has a receptor contact 711 exposed at the receptor insulator 72. The receptor shielding terminal 73 is joined with the receptor insulator 72 to form an insertion space 74 having a lateral insertion opening 741 for a fore-end join portion of the cable end connector 5 to enter the insertion space 74 through the lateral insertion opening 741 such that the cable end contact 511 and the receptor contact 711 are in electrical connection, and the cable end shielding terminal 53 and the receptor shielding terminal 73 are in electrical connection. With the connector design, the central conductor 41 of the coaxial cable 4 and the external conductor 43 may be connected electrically with a circuit boar actually. The receptor shielding terminal 73 may has a detection hole 733 for detecting electrical properties of the cable end connector that enters into the insertion space.

Figure 7:
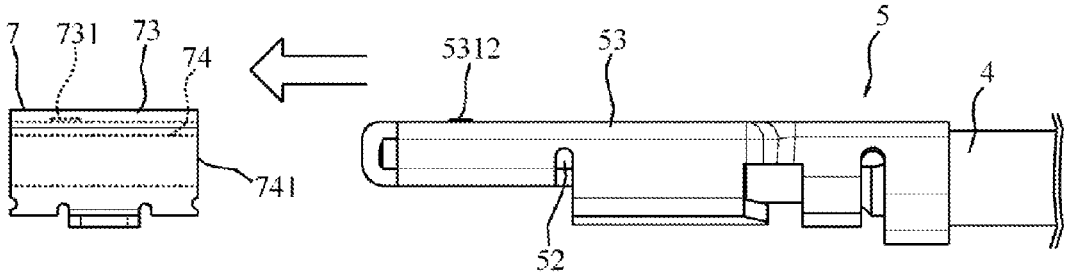
FIG. 7 is a schematic view showing an engagement action of a cable end connector and a receptor connector according to the present invention.
Figure 8:
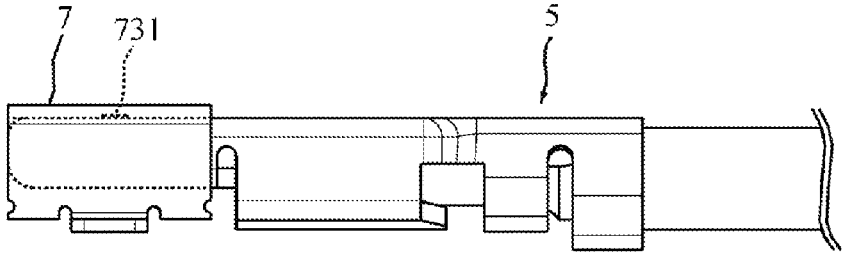
FIG. 8 is a schematic view showing the completion of an engagement action of a cable end connector and a receptor connector according to the present invention.

Refer further to FIGS. 7 and 8, which are schematic views showing an engagement action of a cable end connector and a receptor connector according to the present invention. To engage the cable end connector 5 and the receptor connector 7, the cable end central terminal of the cable end connector 5 and the central conductor of the coaxial cable 4 should be joined in advanced, followed by integrating multiple clamps at the tail portion of the cable end connector 5 with the external conductor and a jacket of the coaxial cable 4 by a crimping method, respectively, to finish the join of the cable end connector 5 and the coaxial cable 4 such that the wire bonding of the cable end connector 5 is completed. After wire bonding, the cable end connector 5 is aligned with the lateral insertion opening 741 of the receptor connector 7, and inserted into the insertion space 74 by a lateral insertion method to complete the engagement action of the cable end connector 5 and the receptor connector 7, as shown in FIG. 8. Similarly, it only needs to extract the cable end connector 5 in the direction opposite to the lateral insertion opening 741 of the receptor terminal connector 7 to release the engagement of the cable end connector 5 and the receptor connector 7.

As shown in FIG. 13, the receptor central terminal 71 is provided with a receptor central terminal pin 712 extending outside the receptor insulator 72. The receptor central terminal pin 712 is extended in the direction opposite to the receptor contact 711 and exposed at the bottom of the receptor insulator 72. The cable end connector 5 engaged to the receptor connector 7 may deliver an electrical signal on the central conductor 41 of the coaxial cable 4 to a circuit board through an electrical connection of the receptor central terminal pin 712 and the circuit board.

Besides, the receptor shielding terminal 73 is further provided with a receptor shielding terminal pin 732 extending outside the receptor insulator 72. The receptor shielding terminal pin 732 is extended in the direction opposite to the receptor engagement structure 731, and is exposed at the bottom of the receptor insulator 72. As the cable end shielding terminal 53 is electrically connected with the receptor shielding terminal 73, the ground signal on the cable end shielding terminal 53 transmitted from the external conductor 43 of the coaxial cable 4 may be delivered to a circuit board through the receptor shielding terminal pin 732 such that the receptor shielding terminal 73 not only may provide an electrical shielding function, but also provide a grounding function through the receptor shielding terminal pin 732. Both the receptor central terminal pin 712 and the receptor shielding terminal pin 732 may be SMT pin or THROUGH HOLE pin that is joined with a circuit board.

The surfaces of the contacts of the receptor shielding terminal pin 732 and the cable end central terminal pin 712 with a circuit board are on the same horizontal surface such that it is helpful for smoothly performing the SMT welding or other connection welding processes of the receptor connector on a circuit board. As shown in FIG. 13, the number of the receptor central terminal pin 712 is one, while the number of the receptor shielding terminal pin 732 is two, but the present invention is not limited thereto. It may depend on requirement to adjust the numbers of the receptor central terminal pin 712 and the receptor shielding terminal pin 732.

The receptor contact 711 is provided with a structure corresponding to the cable end contact 511. For example, the cable end contact 511 and the receptor contact 711 may be provided with a projection portion or a recession portion having corresponding structure relationship, respectively. As the cable connector 5 is engaged with the receptor connector 7, the reliability of the connectors may be improved by the tight contact of the cable end contact 511 and the receptor contact 711 resulting from the fit of the projection and the recession, and retaining electrical connection relationship between the cable end contact 511 and the receptor contact 711.

Figure 19:
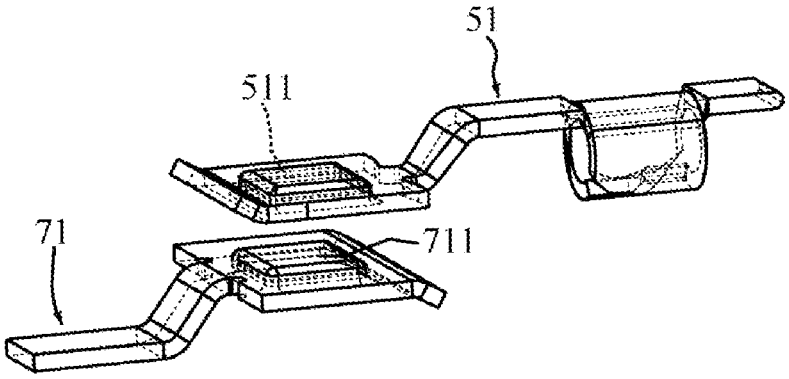
FIG. 19 is a schematic view showing a corresponding contact structure of a cable end contact and a receptor contact according to one embodiment of the present invention.
Figure 20:
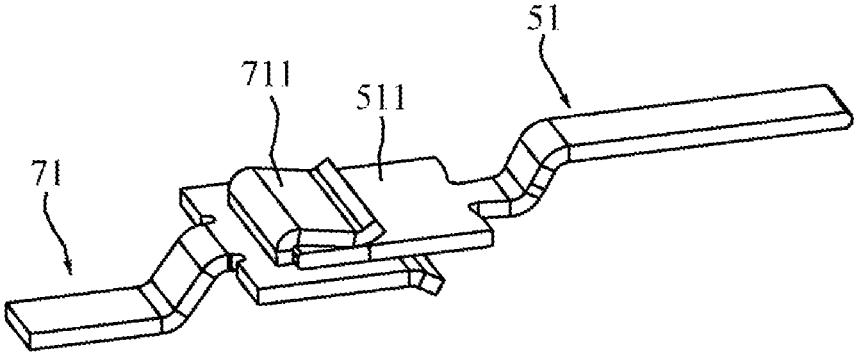
FIG. 20 is a schematic view of a corresponding contact structure of a cable end contact and a receptor contact according to another embodiment of the present invention.

As shown in FIG. 13, the receptor contact 711 is a plane recession structure that may contain the cable end contact 511. Correspondingly, as shown in FIGS. 10 and 11, the cable end contact 511 is a plane projection structure, but the present invention is not limited thereto. Any structure design, such as plate, elastic piece, U-shaped structure, V-shaped structure, etc., that may achieve tight contact of the receptor contact 711 and the cable end contact 511 may be used. As shown in FIG. 19, the receptor contact 711 is a projection structure, and correspondingly, the cable end contact 511 is a recession structure. As shown in FIG. 20, the receptor contact 711 may be selectively designed as a clamping structure or an elastic piece structure for clamping the cable end contact 511.

As shown in FIG. 10, the cable end shielding terminal 53 is provided with a head portion 531, a tail portion 532 connected with the head portion 531. The head portion 531 is at a front half portion of the cable end shielding terminal 53 with a stopping structure 5311 arranged to be bended and extended toward the front end of the cable end insulator 52 to stop and limit the cable end insulator 52. One end of the tail portion 532 of the cable end shielding terminal 53 opposite to the head portion 531 is provided with a first clamp part 5324 and a second clamp part 5325. The external conductor 43 of the coaxial cable 4 may be contained in the first clamp part 5324. A jacket 44 of the coaxial cable 4 may be contained in the second clamp part 5325. By a curling crimping means, the first clamp part 5324 and the second clamp part 5325 may tightly clamp the external conductor 43 and the jacket 44 of the coaxial cable 4, respectively, such that the concentricity of the coaxial cable 4 may be kept after crimping. A ground signal delivered by the external conductor 43 of the coaxial cable 4 may be delivered to the cable end shielding terminal 53 through the contact of the first clamp part 5324 and the external conductor 43.

Refer further to FIG. 7, a receptor engagement structure 731 is arranged on a surface of a receptor shielding terminal 73 facing a receptor insulator 72. The cable end engagement structure 5312 is arranged on a surface of the cable end shielding terminal 53 opposite to the cable end insulator 52 (that is, the rear surface of the cable end shielding terminal 53). As the cable end contact 511 is entered into an insertion space 74 and electrically connected to a receptor contact 711, the receptor engagement structure 731 may engage the cable end engagement structure 5312, such that the effectiveness of the engagement may be confirmed and the strength and reliability of the engagement of the cable end connector 5 and the receptor connector 7 may be enhanced effectively. It is noted that the cable end engagement structure 5312 and the receptor engagement structure 731 may be a projection structure or a recession structure, respectively. By the engagement of the projection structure and the recession structure, the join strength of the cable end connector 5 and the receptor connector 7 may be enhanced to prevent the cable end connector 5 from being detached from the receptor connector 7 by an external impact force. Also, the effectiveness of the engagement can be confirmed such that the strength and reliability of the engagement may be enhanced effectively.

Moreover, the cross-section area of the receptor shielding terminal 73 may be expanded from the interior towards the lateral insertion opening 741 to form on the inner wall a guidance structure for guiding the fore-end portion of the cable end connector 5 to enter the insertion space 74. Thus, even though the entrance angle formed by the moving direction of the fore-end portion of the cable end connector 5 and the lateral insertion opening 741 is larger than 90 degrees, the fore-end portion of the cable end connector 5 may still enter the insertion space 74 with the guidance of the guidance structure. The guidance structure may be a guidance surface or a guidance groove.

As shown in FIGS. 10 to 11, the fore-end of the cable end insulator 52 is a structure design fixing the cable end central terminal 51 and exposing the cable end contact 511 on the top. The size of the cable end shielding terminal 53 fits the cable end insulator 52 such that the cable end insulator 52 may be contained in a internal space of the cable end shielding terminal 53. In this embodiment, the height at the fore-end of the cable end insulator 52 is lower than that at the rear-end to form a ladder structure such that the fitting receptor connector 7 may be designed with a lower height. The periphery of the fore-end of the cable end insulator has a recession area 524 to allow the stopping structure of the cable end shielding terminal to enter. The rear-end of the cable end insulator 52 adopts a hollow frame design, on the middle portion of which a via 521 is formed. The cable end central conductor junction 512 of the cable end central terminal 51 may be arranged in the via 521 on the rear end of the cable end insulator 52. A pair of wing plates 5321 are extended upwards on both sides of the tail portion 532 of the cable end shielding terminal 53. Said pair of wing plates 5321 may be bended to each other inwards to cover the upper edge of the cable end insulator 52, and cover the via 521 on the upper edge of the insulator 52, such that the cable end central conductor junction 512 inside the cable end insulator 52 is shielded to ensure that the signal transmission of the cable end connector 5 is not influenced or shorted by outside impact.

The rear-end of the cable end insulator 52 has a side wall which adjacent to the via 521. The side wall is provided with a groove 522. The central conductor 41 of the coaxial cable 4 may enter the via 521 through the groove 522. The side wall is provided with an outer wall surface 523 for the fore-end of an insulation layer 42 inside the coaxial cable 4 to abut. It is helpful for a subsequent join work of the central conductor 41 and the cable end central conductor junction 512, and keeps the central conductor 41 suspended in the groove 522, such that the central conductor 41 and the cable end shielding terminal 53 are spaced apart to prevent the transmission of an electrical signal in the central conductor 41 from interference or short.

Figure 12:
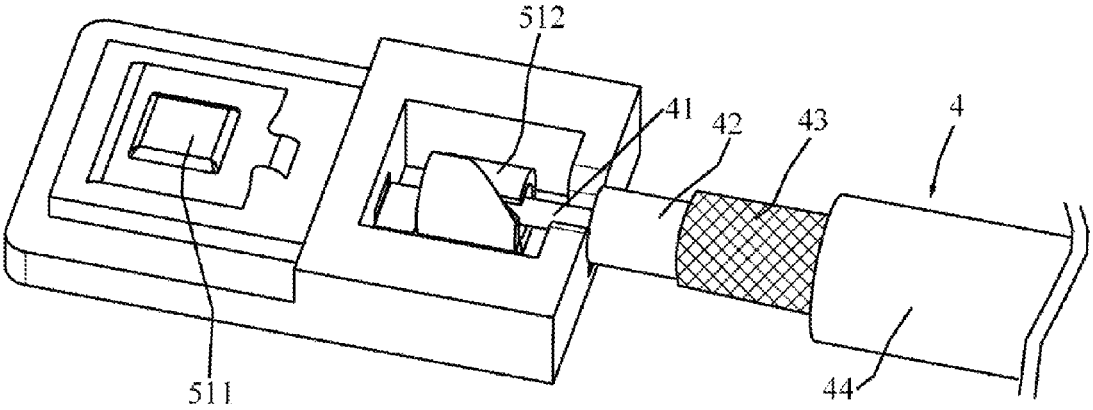
FIG. 12 is a schematic view showing the join of a cable end central terminal and a central conductor of a coaxial cable shown in FIG. 10.
Figure 16:
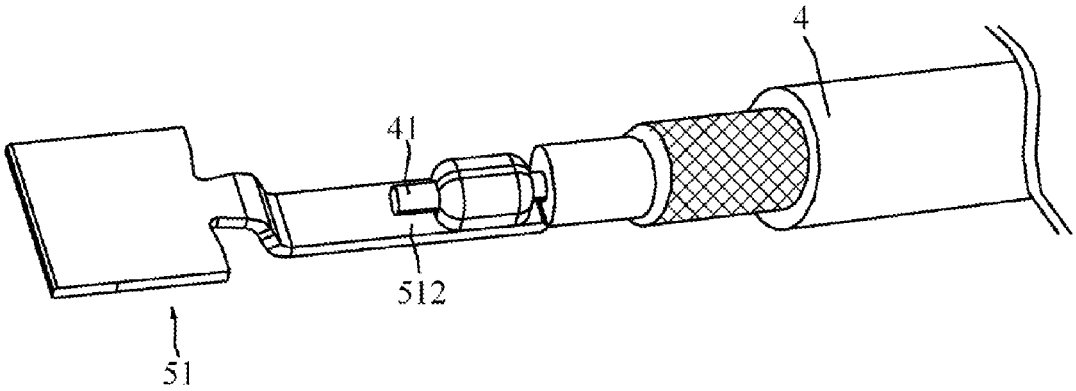
FIG. 16 is a schematic view showing the join of a central conductor of a coaxial cable by a welding method according to the present invention.
Figure 17:
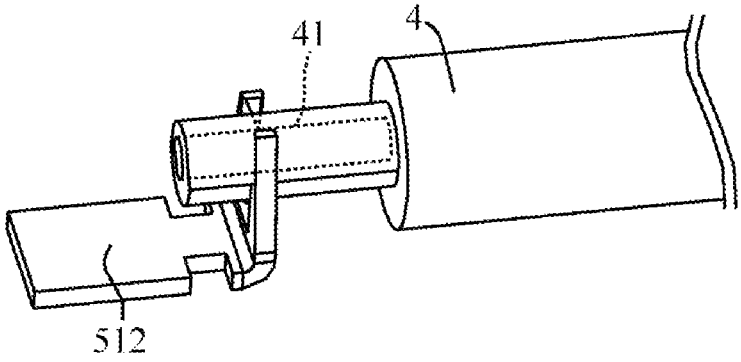
FIG. 17 is a schematic view showing the join of a central conductor of a coaxial cable with an IDC joint according to the present invention.
Figure 18:
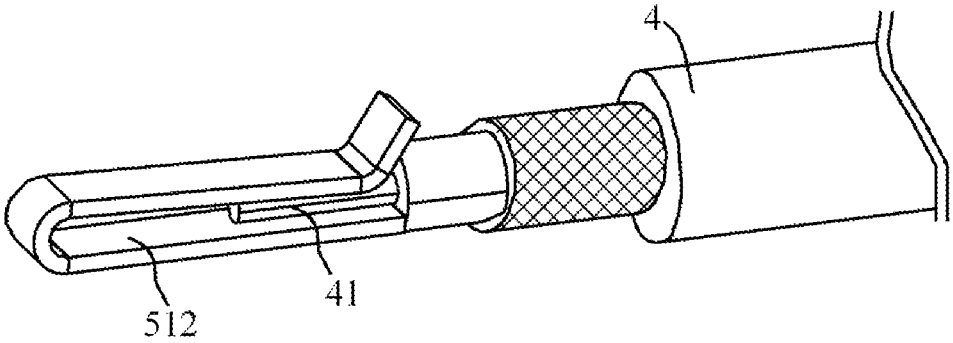
FIG. 18 is a schematic view showing the join of a central conductor of a coaxial cable by pressing according to the present invention.

As shown in FIG. 12, the cable end central conductor junction 512 is joined with the central conductor 41 of the coaxial cable 4 by a crimping method, but the present invention is not limited thereto. Refer further to FIGS. 16 to 18, the cable end central conductor junction 512 may also join with the central conductor 41 of the coaxial cable 4 by welding (as shown in FIG. 16), IDC joint (as shown in FIG. 17), and pressing (as shown in FIG. 18), etc.

Figure 9:
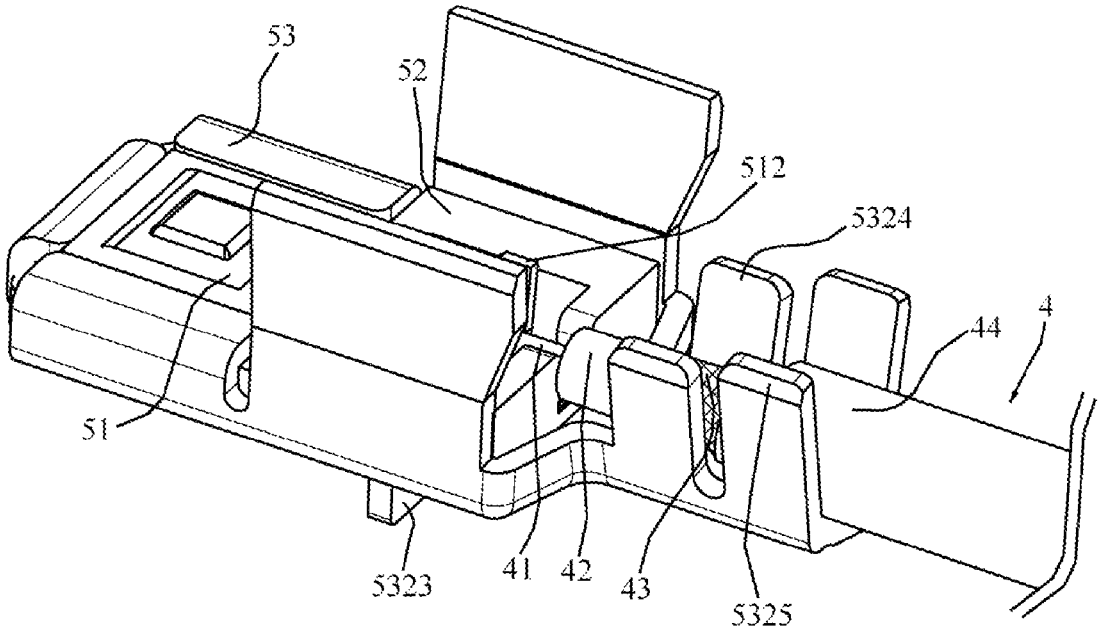
FIG. 9 is a schematic view showing the placement of a coaxial cable before a cable end connector is wire bonded according to the present invention.
Figure 10:
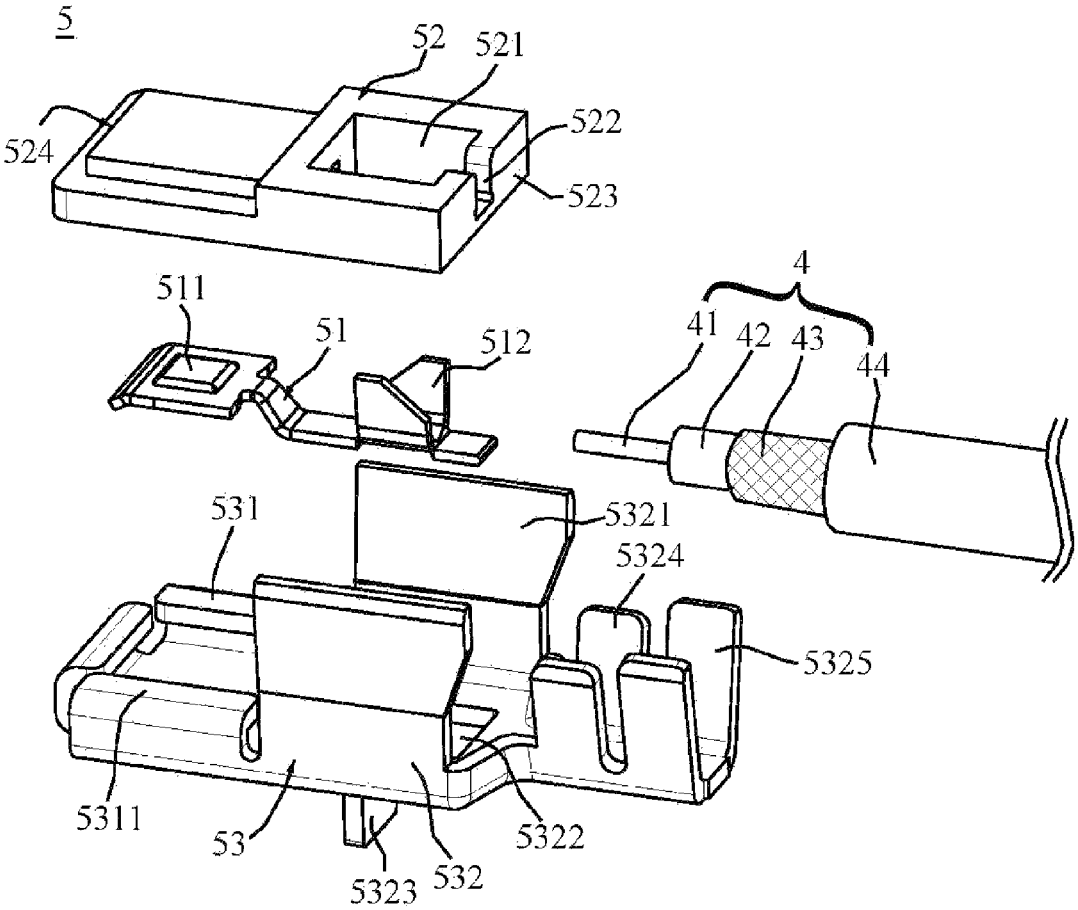
FIG. 10 is a schematic view showing the components of a structure of a cable end connector shown in FIG. 6.
Figure 11:
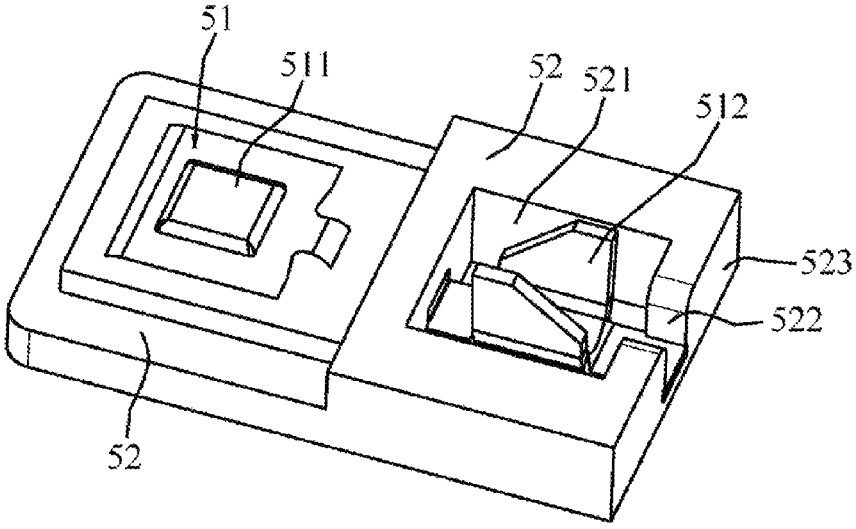
FIG. 11 is a schematic view showing the combination of a cable end insulator and a cable end central terminal shown in FIG. 10.

When the cable end central conductor junction 512 is joined with the central conductor 41 by a crimping method, as shown in FIGS. 9 and 10, a raw hole 5322 may be formed on a position of the cable end shielding terminal 53 corresponding to the cable end central conductor junction 512, and at least one wall surface of the raw hole 5322 is extended outside to form a shielding plate 5323. In crimping, by entering a supporting piece into the raw hole 5322 arranged at the position of the cable end shielding terminal 53 corresponding to the cable end central conductor junction 512, the supporting piece may abut the cable end central terminal 51 on the back of the cable end central conductor junction 512 to provide support when crimping the cable end central conductor junction 512 such that the cable end central conductor junction 512 and the central conductor 41 may be crimped as a part (integrally), as shown in FIG. 12. After the cable end central conductor junction 512 and the central conductor 41 are crimped, the shielding plate 5323 and the wing plates 5321 may be bended to shield the raw hole 5322 and the via 521, respectively, to achieve a shielding effect for the cable end connector 5 and the central conductor 4.

The cable end central terminal 51, the cable end shielding terminal 53, the receptor central terminal 71 and the receptor shielding terminal 73 may be metal sheet object formed by stamping, which may be processed with a surface processing if needed to prevent oxidization or degradation phenomena such that the product service life may be increased. In the embodiments of the present invention, the fore-end of the cable end shielding terminal 53 is designed as a rectangular trapezoidal frame, but the present invention is not limited thereto, and other frame designs that fit the structure of the receptor connector may be utilized alternatively, such as polygonal, arc, oval, or irregular shape and so forth.

Figure 15:
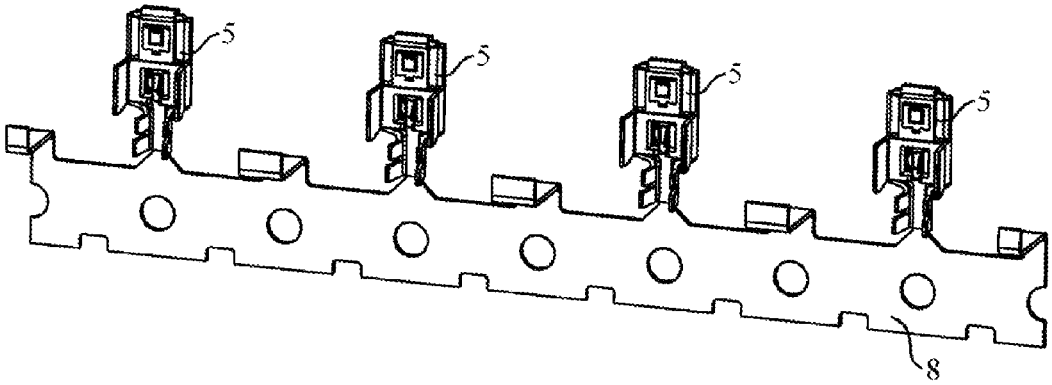
FIG. 15 is a schematic view showing a material strip type cable end connector according to the present invention.

A plastic forming method may be used to form the cable end insulator 52. A SMT high temperature resistant plastic material may be chosen for the receptor insulator 72. By an embedded type injection or combination method, the cable end central terminal 51 and the cable end insulator 52 may be fixed and joined as a part (integrally), and the receptor central terminal 71 and the receptor insulator 72 may be fixed and joined as a part (integrally). As shown in FIG. 5, after the receptor central terminal 71 and the receptor insulator 72 are joined, the receptor contact 711 is flattened and exposed at the upper edge of the receptor insulator 72. Refer further to FIG. 15, the cable end connector of the present invention may further utilize a multiple-serial link method together with the adoption of the material strip type link to be helpful for the manufacturing of terminal and the convenience of line material processing. As shown in FIG. 15, multiple cable end connectors 5 are connected in series on a material strip 8.

In summary, the coaxial cable connector assembly of the present invention includes a cable end connector and a receptor connector. The cable end connector is provided with a cable end central terminal, a cable end shielding terminal. The cable end central terminal may be joined with a central conductor of a coaxial cable. A tail portion of the cable end shielding terminal is provided with multiple clamps, which may be crimped with an external conductor and a jacket of the coaxial cable as a part (integrally) by a crimping method. The receptor connector is provided with a receptor central terminal, a receptor shielding terminal, through which an insertion space having a lateral insertion opening is formed, for a fore-end portion of the cable end connector to laterally enter the insertion space, to complete the engagement of the cable end connector and the receptor connector, such that the cable end central terminal and the receptor central terminal are in electrical connection, and the cable end shielding terminal and the receptor shielding terminal are in electrical connection. An inner wall surface of the receptor shielding terminal may provide a position-limiting function to limit the cable end connector such that it cannot detach from the receptor connector in the direction other than the lateral opening. Thus, a sufficient engagement force may still be provided for the cable end connector even though the height of the receptor connector is very low, such that the cable end connector is not detached from the receptor connector easily by an external impact force, and thereby the use stability of the connectors is improved effectively.

The receptor connector is provided further with a receptor engagement structure to engage the cable end connector entering into the insertion space, such that the engagement may be confirmed effectively, and the strength and reliability of the engagement may be enhanced effectively. Likewise, the cable end connector may also be provided with a cable end engagement structure to engage with the receptor engagement structure, such that the effectiveness of the engagement of the cable end connector and the receptor connector is better.

Additionally, the cross section of the insertion space is expanded gradually towards the lateral insertion opening from the interior. Thus, a guiding structure may be formed on an inner wall surface of the receptor shielding terminal, for guiding the fore-end portion of the cable end connector to enter the insertion space to solve the problem that the small sized lateral insertion opening of the receptor connector is not easily aligned with the cable end connector, such that the operating time and cost for engaging the cable end connector and the receptor connector may be reduced effectively.

What is claimed is:

1. A coaxial cable connector for mating a receptor connector, the coaxial cable including:

a cable end insulator;

a cable end central terminal arranged at the cable end insulator, having a cable end contact exposed at a fore-end of the cable end insulator; and a cable end shielding terminal cladding the cable end insulator, being capable of entering an insertion space of the receptor connector through a lateral insertion opening of the insertion space such that the cable end shielding terminal and a receptor shielding terminal of the receptor connector are in electrical connection, and the cable end contact and a receptor central terminal of the receptor connector are in electrical connection, wherein the cable end shielding terminal has a cable end engagement structure arranged on one surface opposite to the cable end insulator.

2. The coaxial cable connector as recited in claim 1, wherein the cable end shielding terminal has a stopping structure extending toward the fore-end of the cable end insulator to stop and limit the cable end insulator.

3. The coaxial cable connector as recited in claim 2, wherein a recession area is on the periphery of the fore-end of the cable end insulator to allow the stopping structure of the cable end shielding terminal to enter.

4. The coaxial cable connector as recited in claim 2, wherein one end, which is away from the stopping structure, of the cable end shielding terminal extends to form a first clamp part and a second clamp part.

5. The coaxial cable connector as recited in claim 1, wherein the cable end contact has a projection structure or a recession structure.

6. The coaxial cable connector as recited in claim 1, wherein the cable end central terminal joins the central conductor of a coaxial cable by crimping, pressing, welding, or insulation displacement connection (IDC) joint.

7. The coaxial cable connector as recited in claim 1, wherein the cross-section area of the receptor shielding terminal expands from interior toward the lateral insertion opening to form a guidance structure on an inner wall.

8. The coaxial cable connector as recited in claim 1, wherein a pair of wing plates extend upwards on both sides of the rear-end of the cable end shielding terminal, the pair of wing plates can be bended inward oppositely to cover an upper edge of the cable end insulator.

9. The coaxial cable connector as recited in claim 1, wherein a raw hole is formed and shielding plate extends out at the position where the cable end shielding terminal corresponds to the cable end central terminal, the shielding plate can shield the raw hole after bending.

10. A receptor connector for mating a cable end connector, the receptor connector including:

a receptor insulator;

a receptor central terminal, which is arranged on the receptor insulator and has a receptor contact exposed at the receptor insulator; and a receptor shielding terminal, which joins the receptor insulator to form an insertion space with a lateral insertion opening to allow a portion of the cable end connector to enter the insertion space through the lateral insertion opening such that a cable end shielding terminal of the cable end connector and the receptor shielding terminal are in electrical connection, and a cable end central terminal of the cable end connector and the receptor contact are in electrical connection, wherein the receptor contact has a projection structure or a recession structure.

11. The receptor connector as recited in claim 10, wherein the receptor shielding terminal is provided with a receptor engagement structure on its surface facing the receptor insulator to engage the cable end connector that enters into the insertion space.

12. The receptor connector as recited in claim 10, wherein the receptor shielding terminal further has a detection hole for detecting electrical properties of the cable end connector that enters into the insertion space.

13. The receptor connector as recited in claim 10, wherein a receptor central terminal pin extends in the direction away from the receptor contact.

14. The receptor connector as recited in claim 13, wherein the receptor central terminal pin is a surface-mount technology (SMT) pin or a through hole pin.

15. A receptor connector for mating a cable end connector with a cable end central terminal and a cable end shielding terminal, including:

a receptor insulator;

a receptor central terminal, which is arranged on the receptor insulator and has a receptor contact exposed at the receptor insulator; and a receptor shielding terminal, which joins the receptor insulator to form an insertion space with a lateral insertion opening to allow a portion of the cable end connector to enter the insertion space through the lateral insertion opening such that the cable end shielding terminal and the receptor shielding terminal are in electrical connection, and the cable end central terminal and the receptor contact are in electrical connection, wherein a receptor shielding terminal pin extends in the direction away from the receptor engagement structure.

16. The receptor connector as recited in claim 15, wherein the receptor shielding terminal pin is a surface-mount technology (SMT) pin or a through hole pin.

* * * * *